US005145093A

United States Patent [19]

Zeller

[11] Patent Number: 5,145,093

[45] Date of Patent: Sep. 8, 1992

[54] TOOTHPASTE DISPENSER

[76] Inventor: Henry O. Zeller, P.O. Box 13436, Rochester, N.Y. 14613

[21] Appl. No.: 775,414

[22] Filed: Oct. 15, 1991

[51] Int. Cl.[5] ..... B65D 35/28

[52] U.S. Cl. ..... 222/103; 222/105

[58] Field of Search ..... 222/92, 103, 105; 248/108; 206/277; 251/10

[56] References Cited

U.S. PATENT DOCUMENTS

| | | | |
|---|---|---|---|
| 1,242,165 | 10/1917 | Fitzgerald | 222/103 |
| 2,148,321 | 2/1939 | Oplinger | 222/103 |
| 2,857,079 | 10/1958 | Hall | 222/103 |
| 3,155,278 | 11/1964 | Le Baron | 222/103 |
| 3,418,059 | 12/1968 | Robe | 222/103 |
| 4,172,536 | 10/1979 | Holt | 222/103 |
| 4,326,647 | 4/1982 | Pool | 222/103 |
| 5,061,451 | 10/1991 | Gänshirt et al. | 222/103 |

FOREIGN PATENT DOCUMENTS

| | | | |
|---|---|---|---|
| 223438 | 8/1959 | Australia | 222/103 |
| 605016 | 5/1926 | France | 222/103 |
| 810446 | 3/1937 | France | 222/103 |

*Primary Examiner*—Kevin P. Shaver
*Assistant Examiner*—Philippe Dergkshani
*Attorney, Agent, or Firm*—Robert J. Bird

[57] ABSTRACT

A toothpaste dispenser includes a base plate and a shorter cover plate connected at their back ends by a hinge. The front end of the base plate is supported by a stand which also forms a cradle for the upper end of a tube of toothpaste. Pressure on the cover plate dispenses toothpaste from a portion of the tube until that portion is substantially flat. The flattened portion is then doubled over and the tube repositioned in the dispenser. The flattened portion is thereby sealed against reentry of toothpaste, and pressure on the cover plate now dispenses from the next higher portion of the tube.

3 Claims, 3 Drawing Sheets

TOOTHPASTE DISPENSER

BACKGROUND INFORMATION

This invention is a device for dispensing toothpaste or other viscous materials from a collapsible tubular container.

Many viscous fluid materials, such as toothpaste, are packaged in collapsible tubular containers. Contents are dispensed from the container, or "tube", by squeezing a hand and thumb against its sidewall. The tube often gets deformed to such extent that it is unsightly clumsy to handle, and perhaps even difficult to use. Some contents of the tube are often wasted.

Various devices have been made to facilitate dispensing of materials from tubular containers. The most relevant prior art that I know of is a key to progressively wind a tube bottom in a tight roll as the tube is emptied.

SUMMARY OF THE INVENTION

The present invention is a toothpaste dispenser, including a base plate and a shorter cover plate connected at their back ends by a hinge. The front end of the base plate is supported by a stand which also forms a cradle for the upper end of a tube of toothpaste. Pressure on the cover plate dispenses toothpaste from a portion of the tube until that portion is substantially flat. The flattened portion is then doubled over and the tube repositioned in the dispenser. The flattened portion is thereby sealed against reentry of toothpaste therein, and pressure on the cover plate now dispenses from the next higher portion of the tube. The cover plate is approximately half the length of the base plate or shorter. The device is preferably of polypropylene so that the hinge is a living hinge.

DRAWING

DESCRIPTION

Figure 1:
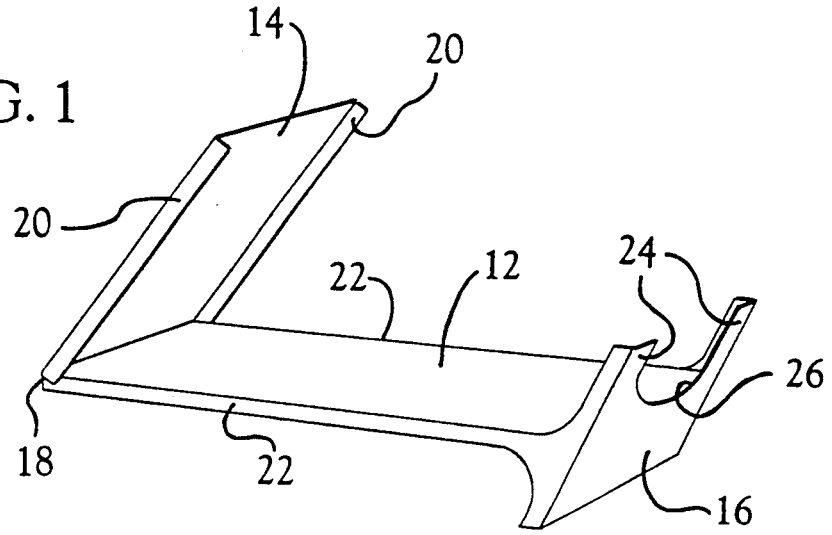
FIGS. 1 and 2 are perspective views of the dispenser of this invention.
Figure 1:
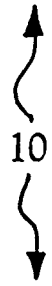

FIG. 1 shows a dispenser 10 including a base plate 12 a cover plate 14, and a front standard 16 supporting the front end of the base plate 12 at a slightly raised position. The cover plate 14 is connected to the back end of the base plate 12 by a hinged connection 18. The length of the base plate 12 approximates that of a medium size tube of toothpaste. The cover plate 14 is approximately half as long as the base plate 12.

The plates 12 and 14 are preferably a unitary piece of polypropylene, a characteristics property of which is that their hinge connection 18 is a "living hinge" with an apparent unlimited duty cycle.

Figure 2:
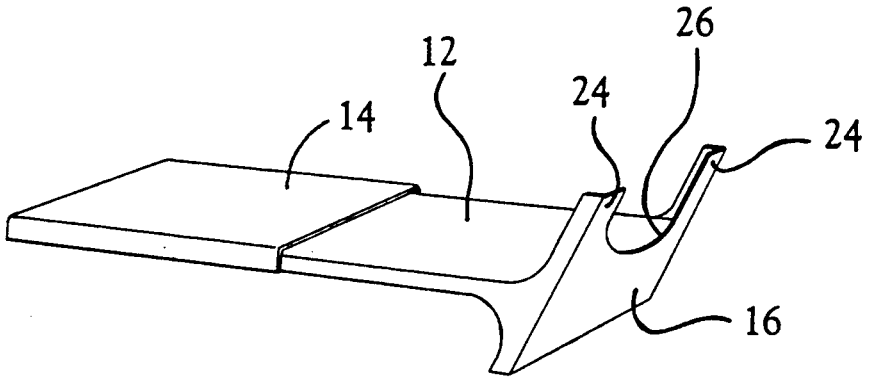

The cover plate 14 includes depending side flanges 20 which fit over the side edges 22 of the base plate 12 when the dispenser is collapsed as in FIG. 2. The front standard 16 includes corner upright members 24 forming a central recess 26 between them.

Figure 3:
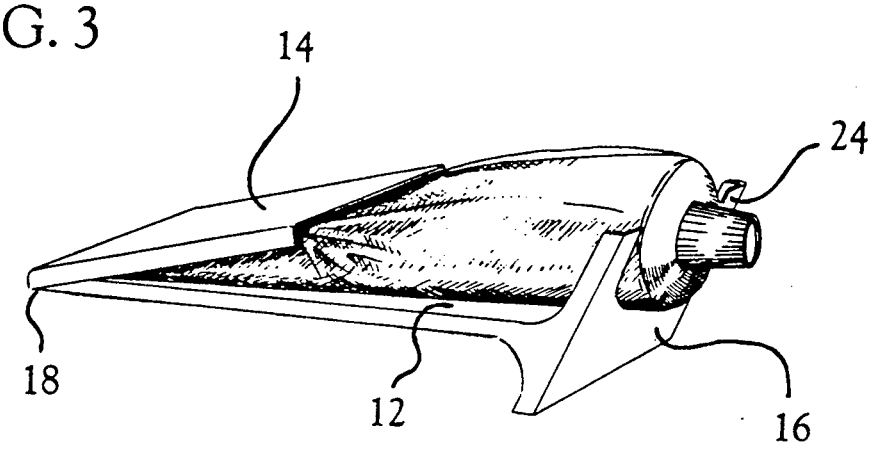
FIG. 3 shows the dispenser and a tube of toothpaste within it.

FIG. 3 shows the dispenser with a tube of toothpaste 30 positioned in it. The depending flanges 20 of the cover plate 14 help to keep the lower end of the tube 30 centered in the dispenser. The upright members 24 and central recess 26 keep the upper portion of the tube centered. The uprights 24 are spaced enough so that the full diameter of the tube (not just its neck portion) is cradled in the recess 26. This permits use of the device with more than one size of tube.

Figure 4:
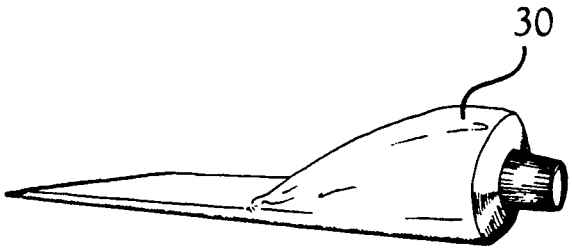
FIG. 4 shows the tube which has been partially emptied.
Figure 6:
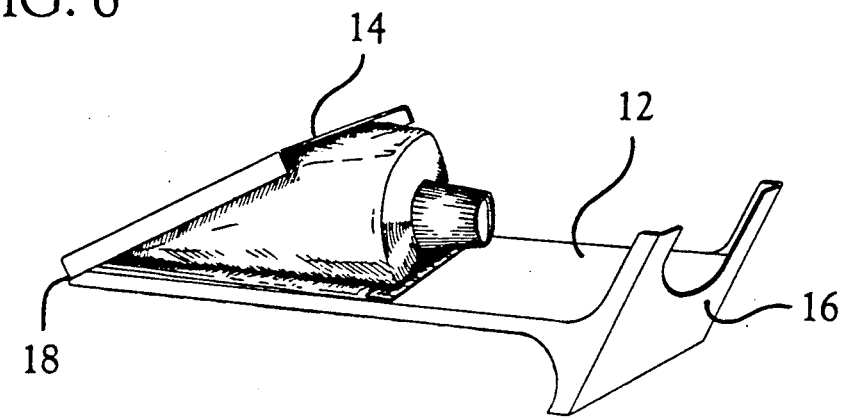
FIG. 6 shows the dispenser with the tube of FIG. 5.
Figure 7:
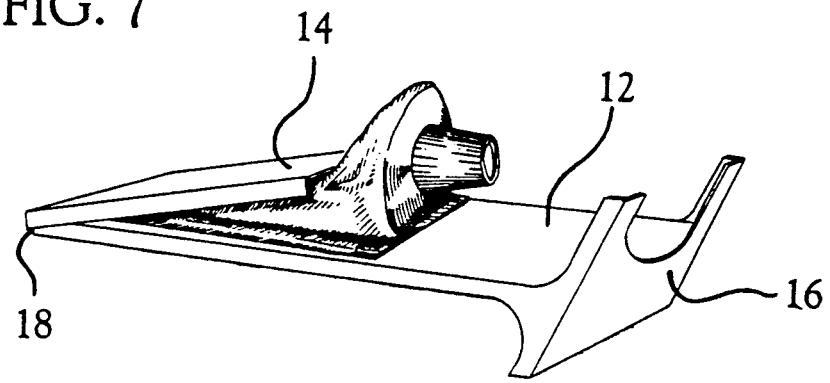
FIG. 7 shows the dispenser with the tube further emptied.
Figure 8:
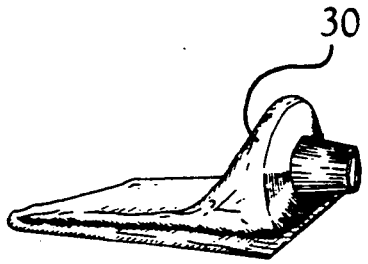
FIG. 8 shows the tube as it is finally emptied by the dispenser.

With a full tube of toothpaste positioned as in FIG. 3, toothpaste is dispensed by pressing down on the cover plate 14. When the lower portion of the tube 30 is empty and flat (FIG. 4) the flattened portion is doubled over (FIG. 5) and the tube put back into the dispenser (FIG. 6). Pressing down on the cover plate 14 now dispenses toothpaste from the upper porion of the tube (FIG. 7) until it too is flat and substantially empty (FIG. 8).

The manual force required to expel toothpaste with this device is related to the length of the cover plate relative to the length of the toothpaste tube. The shorter the cover plate, the smaller the force required to expel toothpaste from the tube, and the longer the cover plate, the greater the force required to expel toothpaste. In the embodiment shown and described, the cover plate 14 is approximately half the length of the base plate 12. This choice permits the device to combine a practical level of applied force with a minimum number of bends of the tube. Other size relationships are possible and are contemplated. A shorter cover plate, one-third the length of the base plate for example, would require less force but would also require an additional bend of the tube.

The depending flanges 20 help to center the toothpaste tube in the dispenser. They also serve another purpose. Before the device is put to use, and when it is not in use, the flanges 20 maintain alignment of the cover plate 14 on the base plate 12. In other words, the flanges 20 prevent the plates from becoming misaligned as a result of creep or the like.

Figure 5:
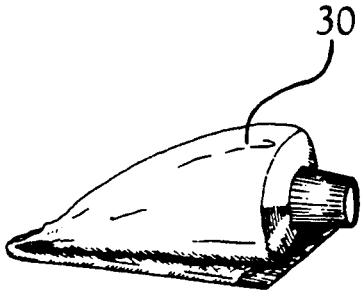
FIG. 5 shows the tube of FIG. 4 with its empty portion doubled over.

FIG. 5 illustrates another advantage to the use of this dispenser. When the empty and flattened lower portion of the tube is doubled over on the rest of the tube, the fold line and the pressure subsequently applied to the fold (FIG. 6) absolutely prevent toothpaste from moving or being forced back into the lower portion of the tube.

This specification relates the dispenser of this invention primarily to toothpaste, to facilitate the description. Clearly, the dispenser is applicable also to other fluid materials that are packaged in collapsible tubular containers, such as caulking or sealing compounds, glue, grease, and the like.

The foregoing description of a preferred embodiment of this invention is intended as illustrative. The concept and scope of the invention are limited only by the following claims and equivalents thereof.

What is claimed is:

1. A dispenser for dispensing fluid material from a collapsible tubular container, including a base plate and a partially overlying cover plate foldably connected along the common back end thereof, said cover plate including depending flanges along the sides thereof to straddle said base plate when said cover plate is folded thereover said cover plate being less than half the length of said base plate; and a front standard supporting the front end of said base plate to elevate the discharge end of said tubular container, said front standard including upright members at each side thereof, forming a central recess between them to cradle the upper portion of said tubular container, the width of said recess being greater than the width of said container; p1 whereby pressure on said cover plate is effective to expel material from the lower portion of said tubular container until said lower portion is flattened and, when said flattened portion is doubled over and said container repositioned in said dispenser, to seal said flattened portion against reentry of material therein and to expel further material from the next higher portion of said container.

2. A dispenser as defined in claim 1 in which said base plate and cover plate and front standard are of a unitary piece.

3. A single-piece dispenser for dispensing fluid material from a collapsible tubular container, including:

a base plate and a cover plate connected at a common back end, said cover plate being foldable over said base plate on a fold line along said back end, said cover plate including depending flanges along the sides thereof to straddle said base plate when said coverplate is folded thereover, said cover plate being less than half the length of said base plate, and a front stand supporting the front end of said base plate to elevate the discharge end of said container, said front stand including upright members at each side thereof forming a central recess between them to cradle the upper portion of said container, the width of said recess being greater than the width of said container;

whereby pressure on said cover plate is effective (i) to expel material from the lower portion of said tubular container until said lower portion is flattened, and (ii) when said flattened portion is doubled over and said container repositioned in said dispenser, to seal said flattened portion against reentry of material therein and to expel further material from the next higher portion of said container.

* * * * *